United States Patent [19]

Grushkin et al.

[11] Patent Number: 4,810,610

[45] Date of Patent: Mar. 7, 1989

[54] CONDUCTIVE SINGLE COMPONENT COLD PRESSURE FIXABLE MAGNETIC TONER COMPOSITIONS

[75] Inventors: Bernard Grushkin, Pittsford; John G. Ruhland, Rochester, both of N.Y.

[73] Assignee: Xerox Corporation, Stamford, Conn.

[21] Appl. No.: 161,687

[22] Filed: Feb. 29, 1988

[51] Int. Cl.[4] ..... G03G 9/06; G03G 9/08

[52] U.S. Cl. ..... 430/106.6; 430/110; 430/903

[58] Field of Search ..... 430/903, 106.6, 110

[56] References Cited

U.S. PATENT DOCUMENTS

| | | | |
|---|---|---|---|
| 3,652,315 | 3/1972 | Matsuo et al. | 430/106.6 X |
| 4,397,941 | 8/1983 | Fickes | 430/331 |
| 4,517,272 | 5/1985 | Tadwin et al. | 430/110 |
| 4,568,625 | 2/1986 | Uchiyama et al. | 430/110 |

FOREIGN PATENT DOCUMENTS

| | | | |
|---|---|---|---|
| 3530909A1 | 3/1986 | Fed. Rep. of Germany | 430/110 |
| 60-192960 | 10/1985 | Japan | 430/106.6 |
| 60-192961 | 10/1985 | Japan | 430/106.6 |
| 61-275860 | 12/1986 | Japan | 430/110 |
| 61-275861 | 12/1986 | Japan | 430/110 |

*Primary Examiner*—Roland E. Martin
*Assistant Examiner*—Jeffrey A. Lindeman
*Attorney, Agent, or Firm*—E. O. Palazzo

[57] ABSTRACT

Disclosed are single component conductive cold pressure fixable toner compositions with a resistivity of from about $5 \times 10^4$ to about $10^7$ ohm-cm for ionographic development systems and comprised of a blend of resin particles and magnetite particles; and present on the surface thereof pigment particles having absorbed thereon release fluids.

14 Claims, No Drawings

CONDUCTIVE SINGLE COMPONENT COLD PRESSURE FIXABLE MAGNETIC TONER COMPOSITIONS

BACKGROUND OF THE INVENTION

This invention is generally directed to single component toner compositions, and more specifically conductive single component magnetic toner compositions wherein release fluids such as silicone oils are adsorbed on conductive pigment particles selected for the compositions. Accordingly, in one embodiment the present invention is directed to a toner composition comprised of a blend of resin particles; magnetite particles, optional external additive particles such as colloidal silicas, metal salts of fatty acids or metal salts; and present on the surface of the toner pigment particles having absorbed thereon release fluids, inclusive of silicone oils. One important magnetic toner composition of the present invention contains therein a mixture of resin particles; magnetite particles; and present on the surface thereof pigment particles which have absorbed thereon release fluids, including those fluids selected as fuser oils for an electrophotographic imaging apparatus, such as those available from Xerox Corporation as the 9200®. The aforementioned toner compositions of the present invention are particularly useful for affecting the development of images in imaging processes wherein fixing is affected by cold pressure methods, and with substantially no heat being utilized.

Numerous toner and developer compositions are known inclusive of those with waxes therein, reference for example British Patent No. 1,442,835. The aforementioned patent illustrates toner compositions comprised of a styrene homopolymer or copolymer resin and at least one polyalkylene compound. According to the disclosure of this patent, reference page 2, beginning at line 90, the starting polymer resin may be either a homopolymer of styrene, or a copolymer of styrene with other unsaturated monomers, specific examples of which are disclosed on page 3, beginning at line 1. Polyalkylene compounds selected for incorporation into the toner compositions disclosed in this patent include those of a low molecular weight, such as polyethylene, and polypropylenes of an average molecular weight of from about 2,000 to about 6,000.

Additionally, there is disclosed in U.S. Pat. No. 4,460,672, entitled "Positively Charged Toner Compositions", a developer composition mixture comprised of electrostatic toner particles consisting of resin particles, pigments particles, low molecular weight waxy materials with a molecular weight of from about 500 to about 20,000, and further included in the composition from about 0.5 percent by weight to about 10 percent by weight of a charge enhancing additive selected from, for example, alkyl pyridinium halides, organic sulfonate compositions, and organic sulfate compositions. The disclosure of this patent is totally incorporated herein by reference.

Magnetic single component toner compositions are also known, which compositions are generally comprised of resin particles, pigment particles, and magnetite. Thus, for example, there is disclosed in U.S. Pat. No. 3,639,245 a dry developer with a specific conductivity, and containing magnetic particles which are blended with a toner resin. Thereafter, and following pulverization the particles resulting are mixed with carbon black and small particle silicone dioxide particles for the purpose of improving flowability. Furthermore, there are disclosed in many patents similar magnetic toner compositions including those comprised of first and second resin particles, pigment particles, magnetites, and low molecular weight waxes such as polyethylenes. Also, single component developer compositions with first and second resin particles, magnetites, and islands or patches of carbon black are described in U.S. Pat. No. 4,569,896. Of interest with respect to the '896 patent is the prior art illustrated in, for example, columns 1 and 2, and the prior art listed on the first page of this patent.

Pressure fixable single component toners with polyamide resins are illustrated in U.S. Pat. No. 4,612,272. More specifically, there is disclosed in this patent a single component developer composition containing at least 50 percent of magnetic oxide, reference column 4, line 28, and a polyamide resin, see for example column 3, beginning at line 53. It is indicated in column 4 of this patent that a highly conductive carbon black pigment is added to the developer for the purpose of providing particles with a surface coating which will render them somewhat conductive. Toners containing the aforementioned polyamides are, however, pressure fixable onto coated paper, reference the working Examples thereof. In contrast, for example, toner compositions of the present invention are pressure fixable onto plain paper. Flowable pressure fixable magnetic toners are also illustrated in U.S. Pat. No. 4,262,077 containing conductive carbon black, reference the Abstract of the Disclosure. Pressure fixable toners for electrostatic development are illustrated in U.S. Pat. No. 3,775,326; and these toners may include optional additives such as metal soap, or a polyhydric alcohol, reference for example the Abstract of the Disclosure. A similar teaching is presented in U.S. Pat. No. 3,873,325. Also, in U.S. Pat. No. 4,108,653 there are described highly conductive, see column 3, beginning at line 11, pressure fixable toner compositions with polyethylene of a weight average of at least 1,500, colorants, and optional additives. In column 2, beginning at line 21, it is indicated that the toners of this patent may contain other resin binders. A similar teaching is present in U.S. Pat. No. 4,355,088. Other patents of interest include U.S. Pat. No. 3,925,219 wherein there is described a toner with a low molecular weight polyethylene, Elvax, and magnetite, reference working Example V; U.S. Pat. Nos. 3,829,314; 3,854,975; 3,873,325; 4,022,738; 4,100,08; 4,206,247; 4,262,077; 4,385,107; 4,397,941; Japanese Abstracts 56-165152, 54-48245, and 56-55954; and 4,529,680.

Of particular interest with respect to the toner compositions of the present invention is U.S. Pat. No. 4,517,272, which illustrates toner compositions with a binder polymer and a low surface energy liquid, such as a silicone oil. According to the teachings of this patent, reference column 1, line 61, the invention provides a novel developer with a toner containing a low surface energy liquid in contact with the polymer resin selected for the toner, some of which is on the surface, and some of which is occulated within the polymer particles. Since the toner compositions of this patent is believed to be insulating, that is such a composition has a resistivity of from $10^{12}$ to about $10^{14}$ ohm-cm, it is not useful as a cold pressure fixable toner for permitting the development of images in ionographic systems, such as those utilized in commercially available Delphax printers. In contrast, the toner compositions of the present invention are conductive, that is they possess a resistivity of from $10^4$ to $10^7$ ohm-cm, thus enabling development of latent images with no background deposits. With further reference to U.S. Pat. No. 4,517,272, there is described therein electrostatic dry toner compositions comprising finely divided polymeric particles admixed with a silicone oil, reference for example column 1, beginning at line 65, and continuing on to column 2, line 41. The inclusion of silicone oils into toners is also described in U.S. Pat. No. 4,568,625, and the corresponding Japanese priority document 59/200, 251-A.

Also, it is known that developer compositions can be selected for rendering visible electrostatic images on a dielectric drum, reference U.S. Pat. No. 4,496,236, the disclosure of which is totally incorporated herein by reference, and wherein there is selected a developer housing such as that described in U.S. Pat. No. 4,692,017, the disclosure of which is totally incorporated herein by reference. Thereafter, the resulting developed latent image can then be transferred directly to a permanent substrate such as paper by contact with the dielectric drum while applying pressure through, for example, a backup roll. This type of development is commonly referred to as transfix. Additionally, in situations where all of the toner is not removed to the paper, that is there remains some toner on the dielectric drum, this has been referred to in the art as offsetting, which is undesirable.

During hot roll fusing, offsetting can be avoided by selecting certain types of fuser rolls the surfaces of which can be covered with a thin film of an offset preventing liquid such as a silicone oil. This approach has been found to be highly effective, however, a comparable process is not usually selected when dielectric drums are utilized since, for example, the oil film will radically alter the characteristics of the dielectric surface and render it unsuitable for a sustained ionographic imaging. Furthermore, the use of silicone oils requires additional components to dispense and meter the oil. It is also known that additives such as metal soaps can be added to the surfaces of toner compositions, which soaps function as a release agent during transfix, reference U.S. Pat. No. 4,355,088; however, although offsetting is prevented using such soaps, dirt is generated which can contaminate and shorten the useful life of other subsystems in the imaging apparatus.

Accordingly, there is a need for improved single component pressure fixable toner compositions that can be selected for ionographic apparatuses, wherein the toner is transferred directly from the dielectric surface to the paper, and permanently affixed to the paper; and wherein silicone oil release devices are avoided. Additionally, there is a need for improved toner compositions with stable triboelectric charging characteristics, wherein surface additives are not a source of machine dirt, and wherein offsetting is substantially avoided. There also is a need for improved toner compositions which can be selected for the development and fixing in ionographic imaging processes wherein the toner particles utilized are substantially free of agglomeration. Furthermore, there is a need for toner compositions comprised of resin particles, which have incorporated thereon a release agent thereby preventing the release oil from migrating within the machine environment. There also remains a need for toner compositions which will not agglomerate or stick together when a release agent such as a mineral oil or silicone oil is selected. Furthermore, there is a need for toner compositions with specific conductivities, and wherein images of excellent resolution with substantially no background deposits are obtained. There is also a need for cold pressure fixable toner compositions with a magnetic component therein, which compositions are substantially completely transferred to a suitable substrate subsequent to development. Additionally, there is a need for single component toner compositions wherein toner offsetting problems are substantially eliminated. In addition, there is a need for toner compositions wherein small amounts of oils can be selected while simultaneously providing sufficient release characteristics for the compositions without adversely effecting pressure fixability, and eliminating undesirable offsetting problems. Furthermore, there is a need for single component cold pressure fixable toner compositions with a resistivity of from $10^4$ to $10^7$ ohm-cm, which enables excellent development, and wherein undesirable background deposits are eliminated. There is also a need for toner compositions with binder resins which can be micronized by, for example, air attrition to about 10 to 30 microns average diameter. Additionally, there is a need for pressure fixable toner compositions wherein the toner particles do not agglomerate upon storage at elevated temperatures.

SUMMARY OF THE INVENTION

It is an object of the present invention to provide single component cold pressure fixable toner compositions with many of the above advantages.

In another object of the present invention there are provided single component cold pressure fixable toner compositions wherein release fluids are absorbed on pigment particles selected for the toner composition.

Additionally, in another object of the present invention there are provided conductive single component cold pressure fixable toner compositions with specific resistivities enabling ionographic development with substantially no background and complete transfer during fusing.

In yet still another object of the present invention there are provided conductive single component cold pressure fixable toner compositions with magnetic components therein, and wherein silicone oils are absorbed on pigment particles present on the toner surface, such as carbon black, which compositions are useful in ionographic printing systems.

Moreover, in yet an additional object of the present invention there are provided toner compositions useful in ionographic printing systems, and wherein these compositions can be permanently fixed to plain paper by cold pressure fusing methods.

Also, in another object of the present invention there are provided conductive single component cold pressure fixable magnetic toner compositions with release fluids such as silicone oils absorbed on the pigment particles, which compositions are particularly useful for effecting the development of images in ionographic imaging apparatuses.

Also, in another object of the present invention there are provided single component cold pressure fixable magnetic toner compositions which do not produce dirt during the development process.

In another object of the present invention there are provided conductive single component cold pressure fixable magnetic toner compositions which can be stored at temperatures of up to 150° F. without adverse agglomeration of toner.

These and other objects of the present invention are accomplished by providing cold pressure fixable single component magnetic toner compositions with release fluids therein. More specifically, in one embodiment of the present invention there are provided cold pressure fixable single component magnetic toner compositions comprised of (1) a blend of resin particles; (2) magnetite; and (3) present on the surface of the toner pigment particles having adsorbed thereon release fluids, such as silicone oils. Accordingly, in one specific embodiment of the present invention the cold pressure fixable single component magnetic toner compositions are comprised of blends of resin particles, and magnetites, which compositions contain on the surface thereof carbon black having absorbed thereon silicone oils. With respect to the aforementioned toner compositions, they possess an important specific resistivity, that is they are conductive, of from about $5\times10^4$ to $10^7$ ohm-cm.

Illustrative examples of resin particles present in appropriate effective amounts and selected for the toner compositions of the present invention include those known suitable thermoplastics such as polyolefins, polyamides, copolymers of ethylene and vinyl acetate, and mixtures thereof. Polyolefins that are preferred are low molecular weight high density polyethylene, polypropylene or copolymers of ethylene and propylene such as Polywax 2000 or Petrolite CP-12, available from Petrolite Corporation. Examples of polyamides include those available from Henkel Corporation such as Versamid 744, Versamid 712, and the like, which have properties desirable for pressure fixing toner. Also, ethylene-co-vinyl acetate resins such as Elvax 410, 420 or 450, obtained from DuPont Company can be selected for the resin blend. Thus, a resin binder blend of Polywax 2000 (about 50 to about 70 percent), Elvax 420 (about 15 to about 25 percent), and Versamid 744 (about 15 to about 25 percent can be admixed with magnetites by melt blending techniques, which compositions are then micronized by mechanical or air attrition to toner size particles of from about 7 to about 30 microns average diameter. In addition, mixtures of polyolefins can be selected to achieve enhanced fusing. Thus, Polywax 2000 (about 10 to about 70 percent), Polywax 500 (about 10 to about 70 percent), Elvax 420 (about 15 to about 25 percent), and Versamid 744 (about 15 to about 25 percent) blended with magnetite.

Examples of magnetic particles include those substances that will render the toner composition magnetic such as mixtures of iron oxides, Mapico Black, and the like, which magnetites are usually present in various effective amounts such as, for example, from about 40 to about 80 percent by weight, and preferably from about 50 to about 65 percent by weight. Additionally, various suitable known pigments, such as carbon blacks, usually present on the toner composition surface in an amount of from about 0.4 percent by weight to about 3 percent by weight, and preferably from about 0.4 percent by weight to about 1.5 percent by weight, are selected.

More specifically, with respect to the toner composition of the present invention, it is important to incorporate the release fluid such as silicone oil on the surface thereof. In one embodiment, this is accomplished by first absorbing pigment particles such as carbon black in an amount of from about 5 to about 25 percent by weight of the carbon black release fluids such as silicone oils. Thereafter, the treated carbon black is surface blended with the toner composition enabling such carbon black with the silicone oil to be retained on the surface of the toner. Thus, for example, a high surface area carbon black is initially dispersed, for example, in a solvent such as a methylene chloride solution containing the low viscosity silicone fluid, which is allowed to evaporate to dryness. Examples of specific carbon black selected are BP 2000 available from Cabot Corporation, Raven 5250 available from Columbian Chemicals Corporation, and the like, especially those with a surface area of from about 300 to about 700 meters squared per gram. In addition, silicone fluids with viscosity of from about 1 to about 5,000 centistokes are preferred. Specifically thus, in one important specific embodiment, a silicone oil with a viscosity of 100 centistokes was selected in the preparation of the treated carbon black, particularly treated BP 2000 with 7.5 weight percent of silicone oil. Accordingly, there resulted a pressure fixable toner which was surface treated with about 0.45 percent of the treated carbon black by blending the two components in a high energy solids mixture such as a Lightnin Mixer resulting, for example, on the toner surface about 0.035 percent of the silicone fluid.

There is selected as the external component for the toners of the present invention, accordingly, carbon black, which has been treated with the release fluids such as silicone oil usually present on the surface of the toner composition in the amounts indicated herein; and this additive is firmly affixed to the toner by, for example, a high speed blender. More specifically, blending is continued until a minimum resistivity of from between about $10^4$ and $10^8$ ohm-cm, and preferably $5\times10^4$ to about $10\times10^7$ ohm-cm has been achieved for the toner composition, which resistivity is measured in a $1\times1$ centimeter cell mounted on a magnet and filled with the aforementioned toner composition. Specifically, the resistivity is determined by measuring the current through the cell when 10 volts is applied to one centimeter squared electrodes on opposite faces of the cell, which are aligned parallel to the poles of the magnet.

The aforementioned single component magnetic toner of the present invention with the low resistivity indicated reduces the ability of the toner to become permanently charged by triboelectrification. Accordingly, with the toner composition of the present invention development of the latent images is primarily dependent on the toner being inductively charged and transferred to the electroceptor in the development field.

Various effective suitable methods may be selected for preparing the toner compositions of the present invention including the dispersion of the pigment particles in a suitable solvent, inclusive of aliphatic halogenated solvents, such as methylene chloride, followed by the addition to the aforementioned solution of a release fluid, inclusive of silicone oils. Mixing is continued for a sufficient period of time to enable the pigment particles to absorb the release fluid. Subsequently, the pigment particles with the absorbed silicone oil thereon are then added to the resin particles, and magnetite particles, to enable the formulation of the cold pressure flexible single component toner illustrated herein. It is in this manner that the pigment particles coat the surface of the resin magnetite mixture.

As indicated herein, the toner compositions of the present invention are particularly useful in ionographic imaging systems, such as those selected for the commercially available Delphax printers, and particularly wherein an electroceptor such as that illustrated in U.S. Pat. No. 4,496,236, the disclosure of which is totally incorporated herein by reference, is selected. In these systems, the latent electrostatic image is created by ion deposition onto the dielectric surface from ion source such as that described in U.S. Pats. Nos. 4,155,093 and 4,160,257, the disclosures of each of these patents being totally incorporated herein by reference. Subsequently, toner transferred to the dielectric surface can be accomplished by an apparatus such as that described in U.S. Pat. No. 4,692,017, the disclosure of which is totally incorporated herein by reference. Subsequently, the toner composition can then be transferred directly from the electroceptor to a suitable substrate such as paper and permanently affixed thereto by contacting the electroceptor with a hard roll surface while the paper passes through a nip. Accordingly, a dielectric cylinder upon which the latent image has been formed functions as an electroceptor and as a pressure roll for fusing. Pressures in the nip generally are from about 100 to about 400 pounds per linear inch can then be applied to affect fusing; however, other pressures can be selected providing the objectives of the present invention are achievable. Preferred pressures are from about 200 to about 300 pounds per linear inch. For further details regarding the apparatus in the aforementioned process, reference is made to the Journal of Imaging Technology, Vol. 12, No. 3, June 1986, pages 144 through 151, the disclosure of which is totally incorporated herein by reference.

The following examples are being supplied to further define specific embodiments of the present invention, it being noted that these examples are intended to illustrate and not limit the scope of the present invention. Parts and percentages are by weight unless otherwise indicated.

EXAMPLE I

There are absorbed a silicone fuser oil, Xerox Part No. 8R79, onto carbon black BP 2000 available from Cabot Chemical Company, by dissolving 0.5 gram of the silicone oil in 100 milliliters of methylene chloride, followed by addition of 3.0 grams of the aforementioned carbon black. Thereafter, the methylene chloride was evaporated by gentle heating over a steam bath and the treated carbon black was vacuum dried at 50° C. and 700 Torr for 24 hours. There was then prepared a toner composition containing a mixture comprised of a blend of 60 percent of magnetite Mapico Black, 28 percent of crystalline polyethylene Polywax 2000 available from Petrolite, 6 percent of Elvax 420, an ethylene vinyl acetate copolymer available from DuPont, and 6 percent of the polyamide resin Versamid 744, available from Henkel Corporation. This blend was melt blended in an extruder, cooled, and micronized by air attrition to 25 microns average diameter. To the toner there was then added 0.5 percent by weight of the above prepared carbon black having adsorbed on its surface the silicone oil, which addition was accomplished in a LABMASTER II Blender. After blending at 6,000 revolutions per minute for 3 minutes, the resisitivity of the resulting single component toner was $5.2\times10^4$ ohm-cm. Subsequently, the above prepared toner composition was incorporated into a Delphax 2460 Printer, and there were obtained 1,000 developed copies without any offsetting occuring as evidenced, for example, by excellent resolution of the images obtained and absence of deletions and background. Further, transfer efficiency, as determined by collecting toner from the cleaning subsystem and comparing that to the amount of toner used, was 99.6 percent.

EXAMPLE II

A toner composition was prepared by repeating the procedure of Example I, with the exception that there was selected 1.0 gram of silicone oil per 3.0 grams of BP 2000 carbon black. With this composition, 0.67 percent by weight of the treated carbon black was added to the surface resulting in a toner with a final resistivity of $1.6\times10^5$ ohm-cm. When this toner composition was incorporated into the Delphax 2460 Printer of Example I, substantially similar results were obtained. Prints were made with a nip pressure of 250 pounds per linear inch. The reflection optical density of a solid area, as measured on a Macbeth Model RD 9223 densitometer, was 1.55, and no toner offsetting was observed.

EXAMPLE III

A toner composition was prepared by repeating the procedure of Example I, with the exception that there was selected 0.39 percent by weight of carbon black BP 2000, and no silicone oil was utilized. The resulting toner had a resistivity of $1.6\times10^5$ ohm-cm. When this toner composition was incorporated into the Delphax 2460 Printer, offset occurred within the first 50 copies as evidenced by solid area deletions, and the reprint of the deletions on the next copy exiting from the printer.

EXAMPLE IV

A toner composition was prepared by using a mixture of 40 percent of a copolymer of styrene and n-butyl methacrylate in a weight ratio of 65/35 and a molecular weight of approximately $7\times10^4$, and 60 percent of Mapico Black magnetite, which were melt blended and micronized to 23 microns. This toner composition was surface treated with 0.49 percent by weight of the silicone oil treated carbon black described in Example I to yield a toner with a resistivity of $5\times10^4$. When this toner composition was incorporated into the Delphax 2460 Printer, no offset occurred. Although images of good optical density, 1.65, were obtained, the images did not adhere well to the paper substrate when pressure fused at 250 pounds per linear inch. Thus, the resulting images could easily be removed by rubbing or with tape so that image characters could not be readily identified.

EXAMPLE V

A toner composition was prepared as in Example IV except that 0.5 percent by weight of silicone oil was added to the mixture of magnetite and copolymer prior to melt mixing. After micronization to 23 microns, the resistivity was determined to be greater than $10^{12}$ since no current could be read when 10 and 100 volts were applied to a $1\times1$ $cm^3$ cell filled with toner. When this toner was incorporated into the Delphax 2460 Printer, images of only low density were obtained with poor solid area development.

EXAMPLE VI

A toner composition was prepared by melt blending a mixture comprised of 14 percent Polywax 500, 14 percent Polywax 2000, 6 percent of Elvax 420, 6 percent Versamid 744, and 60 percent of Mapico Black magnetite, which mixture was then micronized to a toner of 23 microns average diameter. To the toner there was then added the silicone oil treated carbon black, described in Example I, in an amount corresponding to 0.45 percent by weight of the toner. After blending the treated carbon black onto the toner surface, the toner resistivity was determined to be $7.5\times10^4$ ohm-cm. This toner composition was incorporated into a Delphax 2460 Printer from which 1,000 prints were obtained. The resulting developed images possessed excellent resolution without deletions or any evidence of offset. Furthermore, transfer efficiency was determined to be 99.5 percent and the fixability, as determined by creasing the image, was considered as excellent.

EXAMPLE VII

A toner composition was prepared by repeating the procedure of Example I, with the exception that there was selected for a surface additive Regal 330®, which had been treated with silicone oil in an amount corresponding to 0.2 gram of the silicone oil for each 3.0 grams of carbon black. In this situation, 1.75 percent by weight of the treated Regal 330® was required to provide a toner resistivity of $8.9\times10$ ohm-cm after 100 minutes of blending in the LABMASTER II Blender at 6,000 rpm. This toner was incorporated in to the Delphax 2460 Printer, and there wereobtained 2,000 prints which showed no evidence of offset or image deletions. Also, pressure fixability, as measured by determining the amount of toner that remains on the paper substrate after applying and removing Scotch Tape from an imaged area, was less than that toner composition described in Examples I and II.

Other modifications of the present invention will occur to those skilled in the art subsequent to a review of the present application. These modifidations, including equivalents thereof are intended to be included within the scope of this invention.

What is claimed is:

1. Single component conductive cold pressure fixable toner compositions with a resistivity of from about $5\times10^4$ to about $10^7$ ohm-cm for ionographic development systems and comprised of a blend of resin particles and magnetite particles; and present on the surface thereof conductive pigment particles having absorbed thereon release fluids.

2. A toner composition in accordance with claim 1 wherein the release fluid is a silicone fluid with a viscosity of 1 to 5,000 centistokes

3. A composition in accordance with claim 1 wherein from about 3 percent to about 2.5 percent by weight of the release fluid is absorbed on the pigment particles.

4. A composition in accordance with claim 1 wherein the pigment particles are carbon black.

5. A composition in accordance with claim 1 wherein the resin particles are selected from the group consisting of polyolefins, polyamides, ethylene vinyl acetate copolymers, and mixtures thereof.

6. A composition in accordance with claim 1 wherein the resin particles are comprised of polyolefins and a copolymer of ethylene and vinyl acetate .

7. A composition in accordance with claim 1 wherein the resin particles are comprised of a mixture of polyamides, polyolefins, and a copolymer of ethylene and vinylacetate.

8. A composition in accordance with claim 1 wherein the resin particles are comprised of from about 50 to about 70 percent of Polywax, from about 15 to about 25 percent of Elvax, and from about 15 to about 25 percent of Versamid.

9. A composition in accordance with claim 1 wherein the pigment particles are carbon black with a surface area of from about 300 to about 700 meters squared per gram.

10. A composition in accordance with claim 1 wherein the release fluid is a microcrystalline wax with a density greater 0.92 grams/$cm^3$.

11. A composition in accordance with claim 1 wherein the resin particles are comprised of from about 10 to about 70 percent of Polywax 2000, from about 10 to about 70 percent of Polywax 500, from about 15 to about 25 percent of Elvax 420, and from about 15 to about 25 percent of Versamid 744.

12. A toner composition in accordance with claim 4 wherein from about 0.4 to about 3 percent by weight of carbon black particles are selected.

13. A toner composition in accordance with claim 1 wherein the resin blend contains 28 percent of Polywax 2000, 6 percent of Elvax 420, and 6 percent of Versamid 744.

14. A toner composition in accordance with claim 1 wherein the magnetite is present in an amount of about 60 percent by weight.

* * * * *